US009200453B2

(12) United States Patent
Kerwood-Winslow et al.

(10) Patent No.: US 9,200,453 B2
(45) Date of Patent: Dec. 1, 2015

(54) RIDGE VENT MAT AND ROOF RIDGE ASSEMBLY

(75) Inventors: Ted Kerwood-Winslow, Perkiomenville, PA (US); George Caruso, Ambler, PA (US); Michael S. Coulton, North Wales, PA (US); Lori Curtiss Hascher, Asheville, NC (US); James Emory Mathis, II, Canton, NC (US); Jeffrey Scott Denton, Canton, NC (US)

(73) Assignees: Benjamin Obdyke Incorporated, Horsham, PA (US); Colbond, Inc., Enka, NC (US)

( * ) Notice: Subject to any disclaimer, the term of this patent is extended or adjusted under 35 U.S.C. 154(b) by 1341 days.

(21) Appl. No.: 12/700,527

(22) Filed: Feb. 4, 2010

(65) Prior Publication Data

US 2011/0189940 A1 Aug. 4, 2011

(51) Int. Cl.
*F24F 7/02* (2006.01)
*E04D 13/17* (2006.01)

(52) U.S. Cl.
CPC . *E04D 13/17* (2013.01); *F24F 7/02* (2013.01); *E04D 13/172* (2013.01); *E04D 13/176* (2013.01)

(58) Field of Classification Search
CPC ..... F24F 7/02; E04D 13/17; E04D 13/172
USPC ..... 454/365; 52/302.1
See application file for complete search history.

(56) References Cited

U.S. PATENT DOCUMENTS 3,097,991 A * 7/1963 Miller et al. ..... 162/146
3,691,004 A * 9/1972 Werner et al. ..... 428/219
3,876,566 A * 4/1975 Koshak et al. ..... 521/95
4,041,203 A * 8/1977 Brock et al. ..... 428/157
4,212,692 A * 7/1980 Rasen et al. ..... 156/167
4,252,590 A * 2/1981 Rasen et al. ..... 156/167
4,351,683 A * 9/1982 Kusilek ..... 156/167
4,876,950 A * 10/1989 Rudeen ..... 454/365
4,942,699 A * 7/1990 Spinelli ..... 52/57
5,167,579 A 12/1992 Rotter
5,425,672 A * 6/1995 Rotter ..... 454/365

(Continued)

OTHER PUBLICATIONS

Schut, Jan H. Plastics Technology, Composites: Higher Properties, Lower Cost, Aug. 2008.*

*Primary Examiner* — Steven B McAllister
*Assistant Examiner* — Frances F Hamilton
(74) *Attorney, Agent, or Firm* — Howson & Howson LLP

(57) ABSTRACT

A roof ridge vent mat for installation overlying an open roof ridge to provide ventilation to a space beneath a roof is provided. The ridge vent mat is a continuous elongate material of randomly convoluted polymeric filaments having an openwork upper face, an openwork lower face, a plurality of hollow recesses extending into the mat and opening into the lower face, and opposite longitudinally extending openwork side edges. The openwork upper face is formed of randomly convoluted filaments formed to provide a relatively flat surface of sufficient density to catch heads of fasteners. The plurality of hollow recesses is defined by a plurality of upstanding openwork walls of convoluted filaments that extend from the upper face to the lower face of the mat. The upstanding openwork walls are arranged in a latticework structure such that no unobstructed passageway extent through the mat through which wind-blown rain and snow can freely pass into the side edges of the mat and laterally pass through the mat. A ventilated roof ridge assembly including the vent is provided.

21 Claims, 3 Drawing Sheets

(56) References Cited

U.S. PATENT DOCUMENTS

| | | | | |
|---|---|---|---|---|
| 5,651,641 | A * | 7/1997 | Stephens et al. | 405/302.6 |
| 5,673,521 | A | 10/1997 | Coulton et al. | |
| 5,733,825 | A * | 3/1998 | Martin et al. | 442/361 |
| 5,759,925 | A * | 6/1998 | Ballard et al. | 442/199 |
| 5,902,432 | A | 5/1999 | Coulton et al. | |
| 5,960,595 | A * | 10/1999 | McCorsley et al. | 52/199 |
| 5,972,477 | A * | 10/1999 | Kim et al. | 428/175 |
| 6,277,024 | B1 | 8/2001 | Coulton | |
| 6,298,613 | B1 * | 10/2001 | Coulton et al. | 52/199 |
| 6,308,472 | B1 | 10/2001 | Coulton et al. | |
| 6,343,985 | B1 | 2/2002 | Smith | |
| 6,981,916 | B2 * | 1/2006 | Coulton | 454/365 |
| 7,182,688 | B2 * | 2/2007 | Coulton | 454/365 |
| 7,384,331 | B2 * | 6/2008 | Coulton | 454/365 |
| 7,393,273 | B2 | 7/2008 | Caruso et al. | |
| 7,422,520 | B2 | 9/2008 | Coulton et al. | |
| 7,604,536 | B2 | 10/2009 | Coulton et al. | |
| 8,828,162 | B2 * | 9/2014 | Peyras-Carratte et al. | 156/62.2 |
| 2004/0045242 | A1 * | 3/2004 | Lake | 52/396.02 |
| 2005/0090197 | A1 * | 4/2005 | Coulton | 454/365 |
| 2005/0136831 | A1 * | 6/2005 | Coulton | 454/365 |
| 2006/0079173 | A1 * | 4/2006 | Coulton et al. | 454/365 |
| 2008/0220714 | A1 | 9/2008 | Caruso et al. | |
| 2009/0025316 | A1 | 1/2009 | Coulton et al. | |
| 2010/0031423 | A1 * | 2/2010 | Cincotti et al. | 2/207 |

* cited by examiner

FIG.4
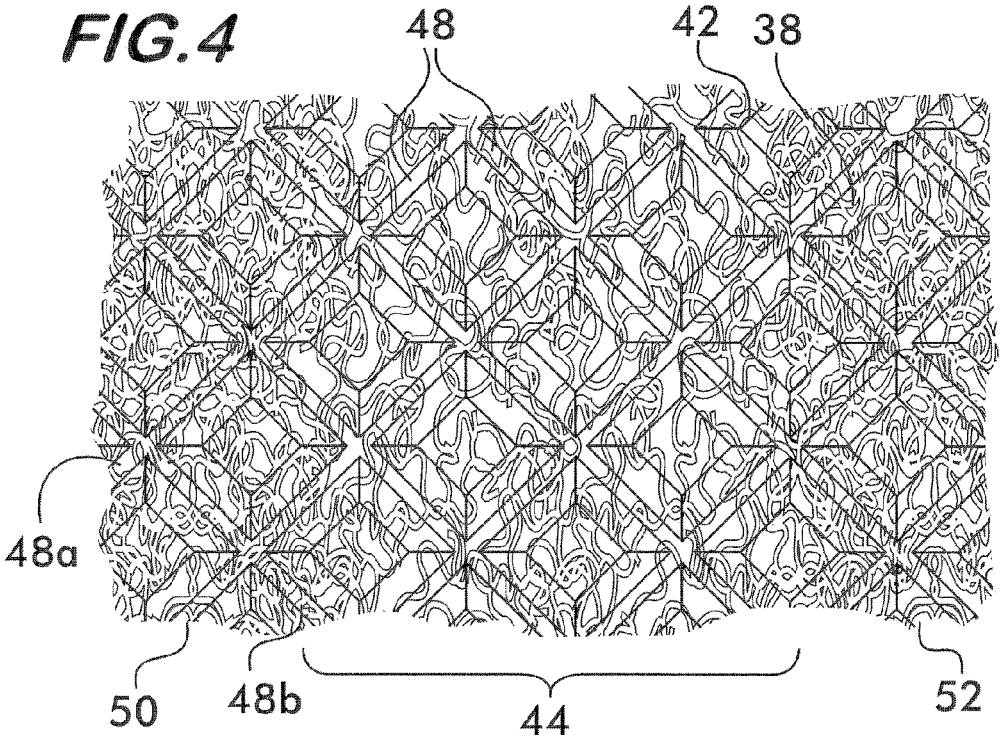
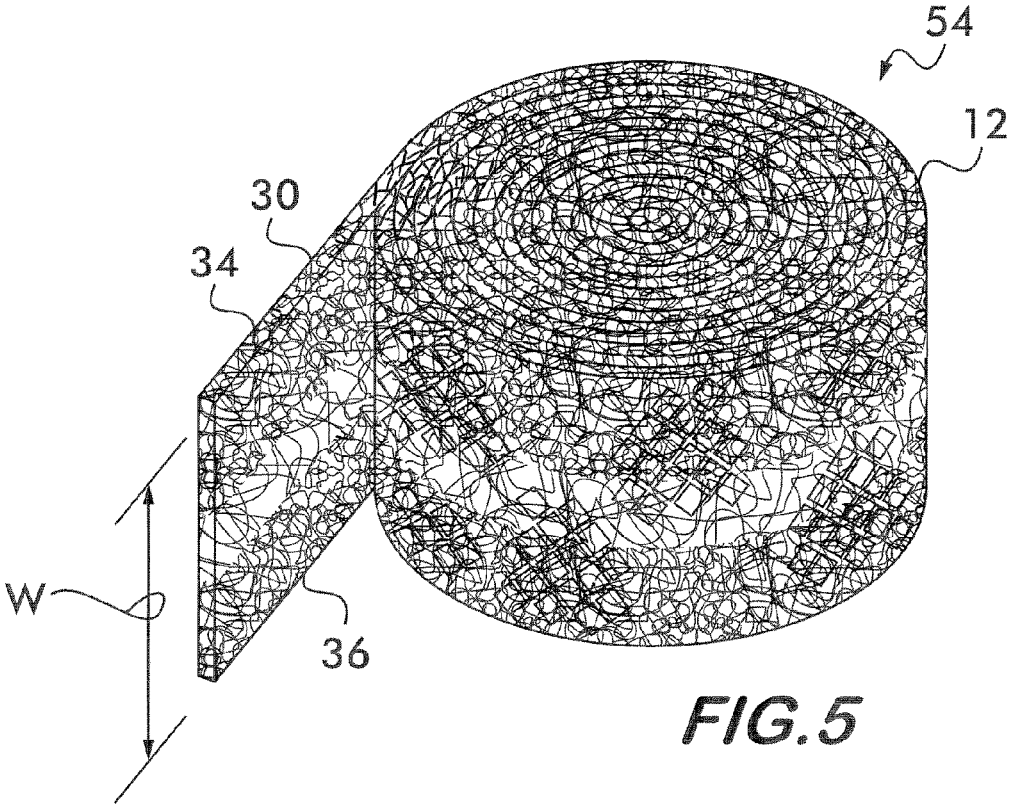
FIG.5

RIDGE VENT MAT AND ROOF RIDGE ASSEMBLY

BACKGROUND OF THE INVENTION

The present invention relates to a roof ridge vent for enhancing the circulation of air in a space between a roof and an underlying structure.

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings.

One known method of venting consists of applying a venting media over a ventilation slot cut along the ridge of a roof. This type of vent is referred to as a ridge vent. Examples of roof ridge vents are disclosed by U.S. Patent Application Publication No. 2008/0220714 of Caruso et al. and U.S. Pat. Nos. 4,942,699 issued to Spinelli; 5,960,595 issued to McCorsley et al.; 5,673,521, 5,902,432, 6,308,472, 6,298,613, 7,604,536, 7,422,520 and 7,393,273 issued to Coulton et al.; and 6,277,024, 6,981,916, 7,384,331 and 7,182,688 issued to Coulton. Other examples are provided by U.S. Pat. Nos. 6,343,985 issued to Smith and 5,425,672 and 5,167,579 issued to Rotter.

While the roof ridge vents disclosed in the above referenced patents and published application may function satisfactorily, there is a need for improved alternatives with respect to a ridge vent capable of efficient and inexpensive manufacture. The ridge vent should be capable of being readily and properly installed in a manner requiring labor skills possessed by the average roof installer and may permit use of standard pneumatic roofing nail guns. Further, the roof ridge vent should be capable of being provided as a continuous, indeterminate-length mat/web which can be stored, transported and supplied to installers in roll-form.

SUMMARY OF THE INVENTION

A roof ridge vent for installation overlying an open ventilation slot of a roof ridge to provide ventilation to a space beneath a roof is provided. The ridge vent is a continuous, elongate mat of randomly convoluted polymeric filaments having an openwork upper face, an openwork opposite lower face, and opposite longitudinally-extending openwork side edges. A plurality of hollow recesses extends into the mat and opens into the lower face of the vent. The openwork upper face is formed of randomly convoluted filaments formed to provide a relative flat surface of sufficient density to catch heads of fasteners and to prevent heads of fasteners from passing through the mat. Thus, the mat does not require the addition of a reinforcement layer of material and relies solely on the filaments of the mat itself for this function.

According to a most economical embodiment of the present invention, the roof ridge vent consists solely of the mat without any dissimilar materials laminated thereto. For example, the mat can consist solely of melt-spun thermoplastic polymeric filaments extruded in overlapping, irregularly-looped patterns with the polymeric filaments being self-bonded and fused at random points of intersection without bonding agents or inserts. The side edges of the mat can be formed by looped uncut sections of the filaments and thus do not even require trimming operations during manufacture of the vent. As an alternative, one or both side edges can be subjected to a trimming, cutting, slitting or like operation.

The plurality of hollow recesses can be separated and defined by a plurality of upstanding openwork walls of convoluted filaments that extend from the upper face to the lower face of the mat. The hollow recesses can have openwork bases made of convoluted polymeric filaments, and the bases can be coplanar with the flat openwork upper face of the mat. Also, the recesses can be arranged in a grid pattern and the upstanding openwork walls can be arranged to form a latticework structure such that no unobstructed passageway extends through the mat through which wind-blown rain and snow can freely pass. According to one contemplated embodiment, the upstanding openwork walls of the latticework structure extend transverse to the side edges and transverse to a longitudinal axis of the mat.

The mat includes a central longitudinally-extending hinge portion and opposite laterally-extending flap portions extending from opposite sides of the hinge portion. The hinge portion is flexible and permits the mat to conform to an inverted-V shape of an underlying roof ridge. The grid pattern of recesses and the latticework structure of upstanding openwork walls preferably extend uniformly and uninterrupted throughout the flap portions and across the hinge portion. In at least some contemplated embodiments, a density of convoluted polymeric filaments within the hinge portion can be less than a density of convoluted polymeric filaments in the opposite laterally-extending flap portions to provide the hinge portion with flexibility.

According to another aspect of the present invention, a roof ridge ventilation assembly is provided. The assembly includes a roof having a ridge with an elongate open ventilation slot, the above referenced ridge vent secured with headed fasteners to the ridge overlying the open ventilation slot, and an exterior covering secured to and overlying the ridge vent.

BRIEF DESCRIPTION OF THE DRAWINGS

The features and advantages of the present invention should become apparent from the following description when taken in conjunction with the accompanying drawings, in which:

FIG. 4 is a plan view of a portion of the planar top side of the roof ridge vent illustrated in FIG. 2; and FIG. 5 is a perspective view of a spiral roll of the vent of FIG. 2.

DETAILED DESCRIPTION OF THE INVENTION

Figure 1:
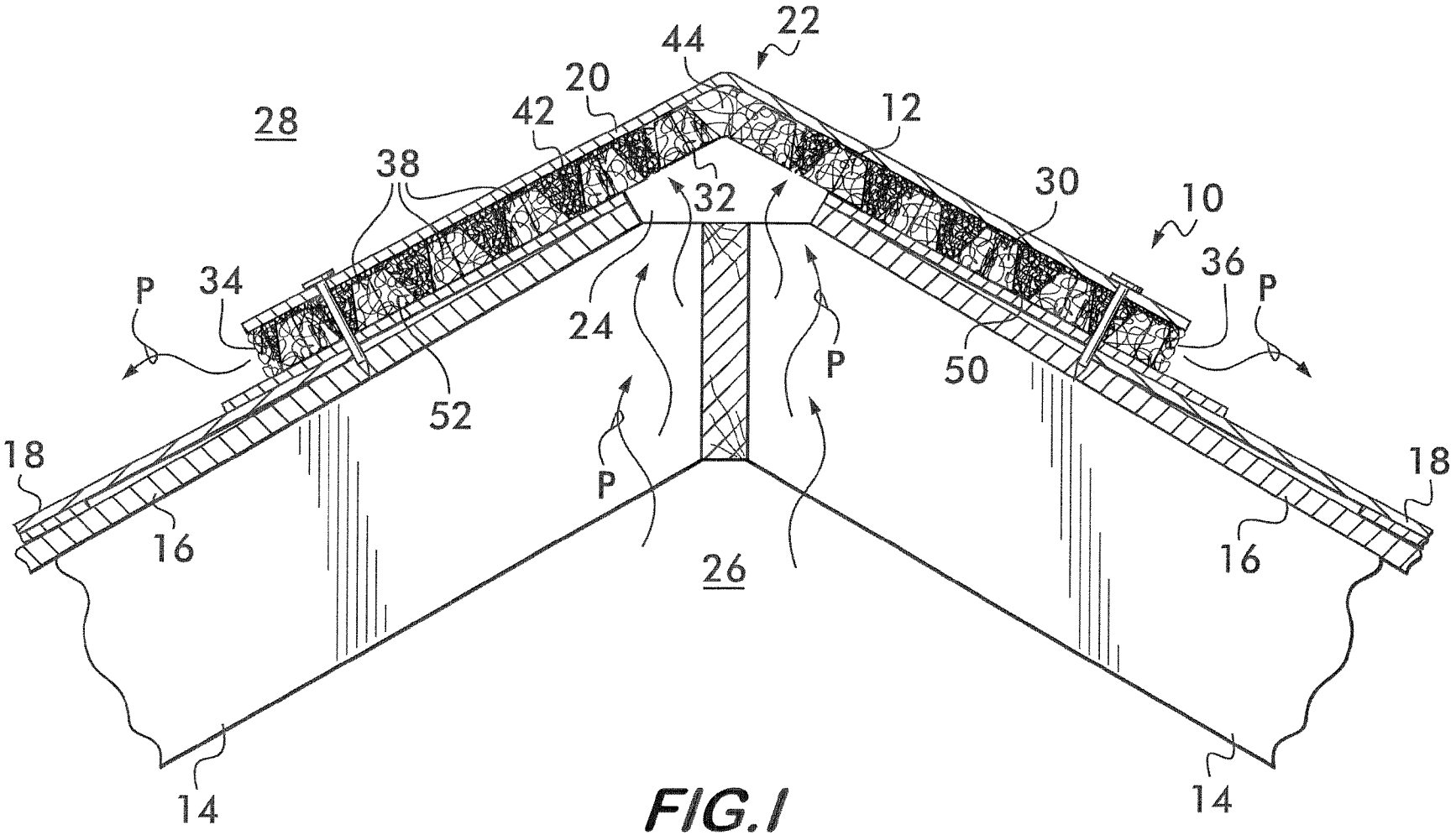
FIG. 1 is a cross-sectional view taken through the elevation of a roof ridge assembly according to the present invention.

FIG. 1 illustrates a roof 10 having a typical construction which utilizes a roof ridge vent 12. The roof 10 is constructed from a plurality of rafters 14 supported at their lower ends, for instance, by front and rear walls (not shown) of the building. A roof deck 16 is typically constructed of plywood, or other suitable panels, to provide an outer sheathing of the building. The roof deck 16 is secured to the rafters 14 and extends to the end walls. Shingles 18 or other exterior coverings are secured to the roof deck 16 to finish sloping portions of the roof 10 in accordance with conventional construction practices. Cap shingles 20 or like coverings are installed in overlapping fashion to cover the roof ridge or peak 22. One or more continuous or discontinuous slots 24 are provided along the length of the roof ridge 22 to provide a passageway for venting air between the underlying attic area 26 and ambient atmosphere 28.

The ridge vent 12 is interposed between the cap shingles 20 and the underlying portions of the roof 10 such that it covers the slot or slots 24. The vent 12 is an openwork roll-form type product which is rolled lengthwise into a spiral roll 54 (see FIG. 4) during manufacture and which is stored, transported and supplied to installers in roll-form. As with other known roll-form ventilation products, the vent 12 is unrolled lengthwise on the roof 10, positioned overlying the roof ridge 22, and secured to the roof 10 with nails, fasteners, adhesives or the like. Thus, the ridge vent 12 provides a continuous, one-piece ventilation product which extends in a substantially straight direction and which is relatively simple to install on a roof ridge 22.

The ridge vent 12 is formed as an elongate, indeterminate-length, single-sheet, openwork mat, or web, 30 of randomly convoluted polymeric filaments. For example, see the spiral roll 54 of the elongate mat 30 illustrated in FIG. 5. The spaces between the polymeric filaments of the mat 30 permit venting of air therethrough typically from a bottom face 32 of the mat 30 overlying the slot 24 to and through the opposite longitudinal side edges, 34 and 36, of the mat 30. For example, see the path of ventilation illustrated in FIG. 1 via arrows "P".

By way of example, a contemplated process for producing the openwork mat 30 is to utilize a method similar to that described in U.S. Pat. No. 4,252,590 issued to Rasen. For instance, continuous melt-spun thermoplastic monofilaments can be extruded onto a profiled support in overlapping rows of irregular loops which are self-bonded or fused at random points of intersection without using any bonding agent or reinforcing inserts. The profile of the support provides a negative image of the bottom face 32 of the mat 30. For example, the profile can include a grid-like arrangement of square truncated cones so that the face 32 of the mat 30 includes a plurality of hollow pyramidal-shaped recesses 38 having generally flat bases 40 at the apex of the point of truncation of the truncated cones of the support. The shape of the recesses 38 can be readily formed by extruding the plastic filaments, while they are still capable of deformation, onto the previously described negative image of the profile of the support such that the filaments assume the surface shape of the profile and then harden in that shape.

In contrast to the face 32 having the plurality of recesses 38, the convoluted polymeric filaments on the opposite face 42 of the mat 30 (i.e., top face of the vent 12) are formed to provide a flat, level, or planar openwork surface. See FIG. 4. In one contemplated embodiment, the flat surface of face 42 is generally coplanar with the bases 40 of the recesses 38; thus, the height "H" of the mat 30 is generally equal to the height of the recesses 38. This height "H" can be, for instance, 0.375 inch, 0.5 inch, 0.75 inch, 1.0 inch, or greater. The face 42 can be subjected to a flattening process while the filaments are still capable of deformation and before the filaments have hardened. This process causes the filaments extending along the face 42 to flatten within a common plane and bond together. See FIG. 4. This face 42 has a higher density of filaments than the other parts of the vent. This provides an advantage in that the face 42 can be utilized as a surface capable of reliably engaging and supporting nail heads or heads of other fasteners for preventing undesired passage of such fastener heads through the face 42 and mat 30. This eliminates the need for laminating a separate sheet material to the mat 30 for purposes of providing a nail head catching support surface which is otherwise required for low-density openwork mats.

Figure 2:
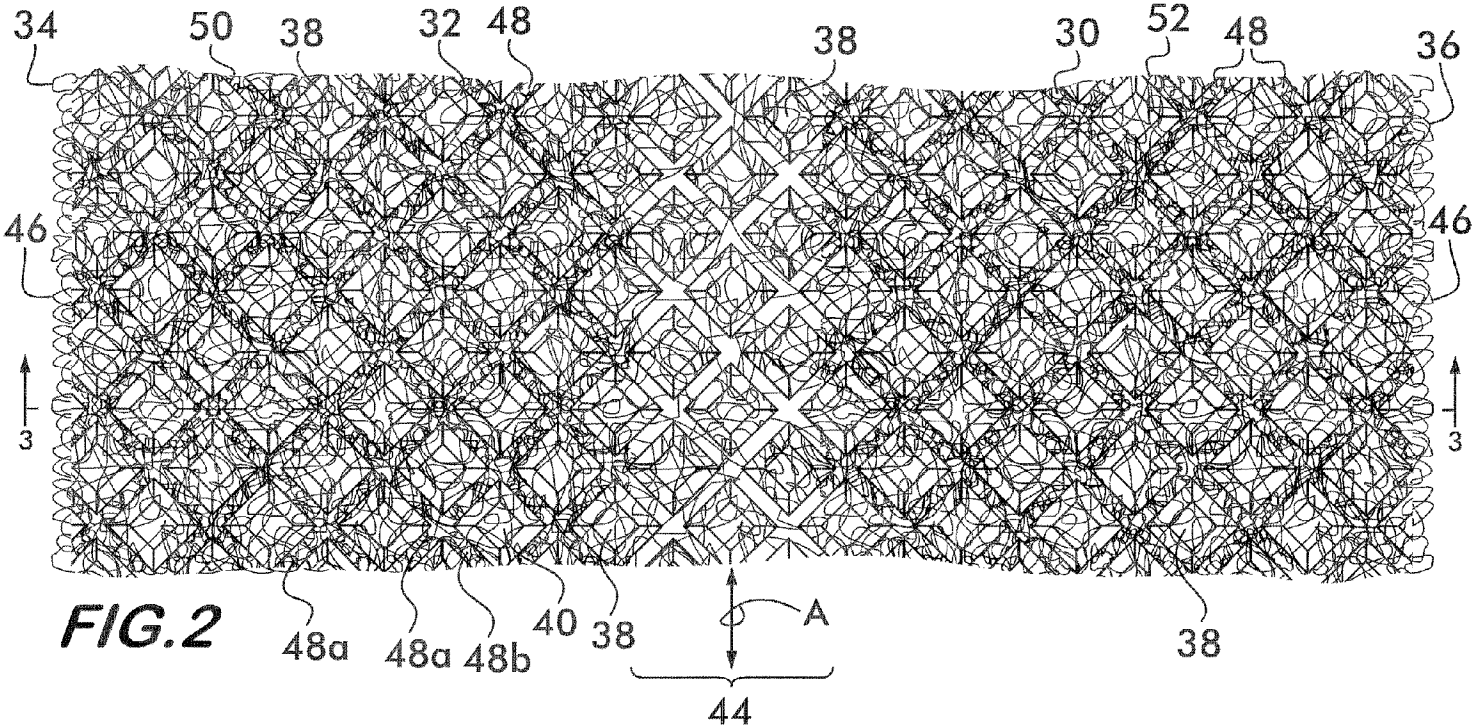
FIG. 2 is a plan view of a given length of the underside of a roof ridge vent according to the present invention.
Figure 3:
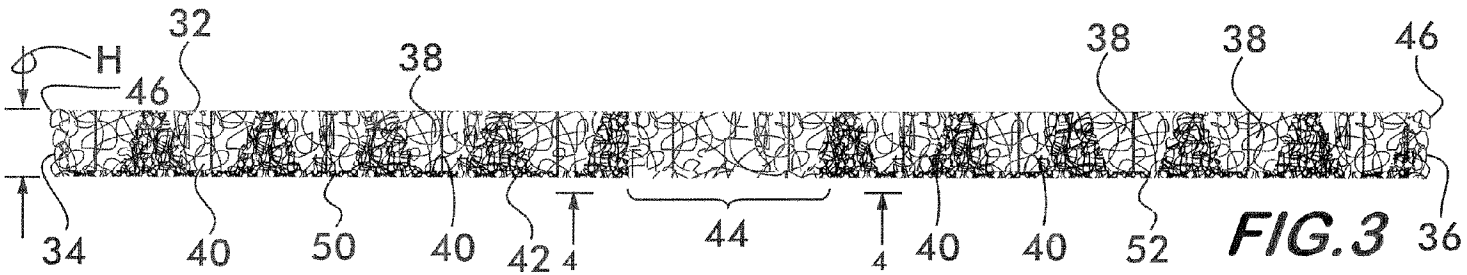
FIG. 3 is a cross-sectional view of the vent along line 3-3 of FIG. 2.

The width "W" of the mat 30 can be provided at any dimension desired for a ridge vent. For example, the width "W" can be 10.5 inches or greater or smaller. The mat 30 is provided as a continuous elongate vent having opposite longitudinally-extending side edges, 34 and 36, that extend substantially parallel to a central longitudinally-extending hinge portion 44 of the ridge vent 12. The side edges 34 and 36 may be formed from looped monofilaments because the mat 30 is made from continuous melt-spun thermoplastic monofilaments extruded in overlapping rows of irregular loops. For example, see edges 34 and 36 as illustrated in FIGS. 2 and 3. Thus, the side edges 34 and 36 are formed during the manufacturing process of the mat 30 and are not formed by a cutting or severing process. Accordingly, the loops 46 of continuous monofilaments form the side edges 34 and 36 of the mat 30 instead of severed ends of filaments. As an alternative, the side edges may be subjected to a cutting, trimming, slitting or like operation such that the side edges are essentially formed by severed ends of filaments having been subjected to a cutting operation.

The hollow recesses 38 are formed in a grid pattern in the mat 30 and open into the bottom face 32 and not the top face 42 of the mat 30. For example, in the cross-sectional views of FIGS. 1 and 3, the recesses 38 are located where pyramidal-shaped sections are illustrated with an amount of filaments in the background that is less dense than surrounding areas. In FIG. 2, the pyramidal-shaped recesses 38 are illustrated by the squares within the illustrated grid pattern. The larger square defines the opening of the recess via the bottom face 32, and the smaller square is the base 40 of the recess 38. Walls 48 formed of randomly convoluted filaments extend from the bottom face 32 of the mat 30 to the bases 40 of the recesses 38 and define and separate the plurality of recesses 38. The walls 48 extend in a grid pattern across the width "W" of the mat 30. Thus, for instance, walls 48*a* extend parallel to one another and substantially perpendicular to the walls 48*b*. The walls 48, including walls 48*a* and 48*b*, do not extend parallel to the side edges, 34 or 36, or to the longitudinal axis "A" of the mat 30. Rather, the walls 48, including walls 48*a* and 48*b*, extend at a transverse angle such as at an angle of about 45° relative to the side edges, 34 and 36. For example, see FIG. 2. The significance of this arrangement is that the convoluted filaments of the walls 48 prevent wind-blown water, precipitation, snow or the like or other unwanted foreign objects from passing through the side edges 34 and 36 of the mat 30 and through the body of the mat 30. For example, there are no open gaps provided by the walls 48 that permit an unblocked path for wind-blown rain or snow to pass into the side edges 34 and 36 and through the body of the mat 30 to the location of the slot 24 in the roof ridge 22, despite the existence of the plurality of recesses 38.

According to one particularly economical embodiment of the present invention, the ridge vent 12 consists solely of the mat 30 without the use of any fabric backing layer or like separate material laminated to the openwork mat 30. The arrangement of monofilaments of the mat 30 is sufficiently dense, particularly with respect to walls 48, to prevent wind-blown water, precipitation, snow or the like or other unwanted foreign objects from passing into the side edges 34 and 36 of the mat 30 and through the mat 30. In addition, the flat upper face 42 of the mat 30 is sufficient to catch and support nail heads. Of course in some less-economical embodiments, a separate fabric or like material could be laminated to the mat 30 should additional nail head support or weather barrier protection be desired.

The hinge portion 44 of the mat 30 extends along the central longitudinal axis "A" of the mat 30 and defines opposite laterally-extending flap sections, 50 and 52, of the vent 12. In the hinge portion 44, the amount or density of convoluted filaments can be reduced relative to that in the flap sections 50 and 52. For example, see the hinge portion 44 in the cross-sectional view of FIG. 3. Accordingly, the central hinge 44 is readily flexed during installation to conform the vent 12 to the inverted-V shape of the roof ridge 22 of the roof 10. However, the flap sections 50 and 52 extending from opposite sides of the central hinge portion 44 can have greater density of monofilaments and thus be of greater rigidity. Of course, the entire mat 30 is sufficiently flexible to be wound up into a spiral roll for shipment and storage.

The ridge vent 12 consisting of the mat 30 described above can be fastened to the roof deck 16 with nails or like fasteners. The face 32 of the mat 30 with the plurality of recesses 38 formed therein is disposed downward and engages the underlying structure of the roof on opposite sides of the slot 24 and roof ridge 22. The opposite flattened face 42 of the mat 30 faces upward and nails or other headed fasteners are inserted therein to secure the vent 12 to the roof deck 16. The heads of the nails or fasteners are caught and supported by the flat surface of openwork face 42 of the mat 30. The cap shingles 20 are applied on top of the vent 12 thereby hiding the ridge vent 12 from view. The side edges 34 and 36 of the mat 30 are exposed to ambient atmosphere, and the openwork nature of the mat 30 permits an appropriate amount of air flow through the mat 30 so that the needed ventilation of the building's attic occurs via the slot 22 and overlying ridge vent 12 to ambient atmosphere.

In one contemplated embodiment, the mat 30 is constructed from a series of continuous polypropylene, nylon 6, polyethylene, or high density polyethylene monofilaments which have a diameter of from about 200 to about 1000 microns. The weight of the mat 30 can range from about 20 to about 100 grams per square foot. The formation of the recesses 38 in the body of the mat 30 enables the weight of the mat 30 to be reduced to these levels yet still provide resistance to weather, nail head support capability, and crush resistance. The density of the filaments can be essentially constant throughout the mat 30, except within the central hinge section 44 in which the density can be less than that of the outer flap sections 50 and 52 to accommodate flexing of the vent 12 across the roof ridge 22.

The above-described roof ridge vent 12 provides a roll-form vent which is easy to install, inexpensive to manufacture, particularly when the vent consists solely of the openwork mat without other layers laminated thereto, and enables use of standard pneumatic roofing nail guns and like tools. Further, the vent provides a desired capacity of air flow through the mat and prevents unwanted intrusion of blowing rain, snow and the like.

While a preferred ridge roof vent has been described in detail, various modifications, alterations, and changes may be made without departing from the spirit and scope of the vent according to the present invention as defined in the appended claims.

The invention claimed is:

1. A roof ridge vent, consisting of a continuous, elongate mat of randomly convoluted polymeric filaments without any dissimilar materials laminated thereto, said mat having an openwork upper face, an openwork opposite lower face, a plurality of hollow recesses extending into the mat and opening only into said lower face and not said upper face, and opposite longitudinally-extending openwork side edges, said plurality of hollow recesses being separated and defined by a plurality of upstanding openwork walls extending from said upper face to said lower face and made of said randomly convoluted polymeric filaments, said plurality of upstanding openwork walls being arranged to provide a latticework structure such that said plurality of recesses is arranged in a grid pattern defined by said latticework structure of said upstanding openwork walls and such that said upstanding openwork walls extend diagonally across said mat relative to said side edges and a longitudinal axis of said mat, the randomly convoluted polymeric filaments forming said openwork upper face of said mat having been subject to a flattening process while the filaments were capable of deformation and before the filaments had hardened so that the filaments extending along said openwork upper face provide a flat surface, extend within a common plane, and said randomly convoluted polymeric filaments being self-bonded and fused together, and the openwork upper face of said mat having a higher density of filaments than a remainder of said mat extending below said openwork upper face.

2. A roof ridge vent according to claim 1, wherein said mat consists of melt-spun thermoplastic polymeric filaments extruded in overlapping, irregular-looped patterns with said polymeric filaments being self-bonded and fused at random points of intersection without bonding agents or inserts.

3. A roof ridge vent according to claim 1, wherein said hollow recesses have bases made of said randomly convoluted polymeric filaments that form parts of said openwork upper face of said mat.

4. A roof ridge vent according to claim 3, wherein said latticework structure provides no unobstructed free passageways for wind-blown rain and snow into said side edges of said mat and laterally through said mat.

5. A roof ridge vent according to claim 3, wherein said upstanding openwork walls of said latticework structure extend across said mat from one of said side edges to the other at a 45° angle to said side edges and to the longitudinal axis of said mat.

6. A roof ridge vent according to claim 1, wherein said side edges of said mat are formed by looped uncut sections of said filaments.

7. A roof ridge vent according to claim 1, wherein said side edges of said mat include severed ends of said filaments.

8. A roof ridge vent according to claim 3, wherein said mat includes a central longitudinally-extending hinge portion and opposite laterally-extending flap portions extending from opposite sides of said hinge portion, wherein said hinge portion is flexible and permits said mat to conform to an inverted-V shape of an underlying roof ridge, and wherein said upstanding openwork walls extend uninterrupted across said hinge portion.

9. A roof ridge vent according to claim 8, wherein said grid pattern of recesses and said latticework structure of upstanding openwork walls extend uniformly and uninterrupted throughout said flap portions and across said hinge portion.

10. A roof ridge vent according to claim 8, wherein a density of convoluted polymeric filaments within said hinge portion is less than a density of convoluted polymeric filaments in said opposite laterally-extending flap portions.

11. A roof ridge vent according to claim 1, wherein said mat consists of 20 to 100 grams of polymeric filaments per square foot of said mat.

12. A roof ridge vent according to claim 1, wherein said mat is rollable into a spiral roll for storage and shipment.

13. A roof ridge ventilation assembly, comprising:

a roof having a ridge with an elongate open ventilation slot;

a ridge vent mat secured to said ridge and overlying said open ventilation slot; and an exterior covering secured to and overlying said ridge vent mat;

said ridge vent mat consisting of an elongate mat of randomly convoluted polymeric filaments having an openwork upper face, an openwork opposite lower face, a plurality of hollow recesses extending into said mat and opening only into said lower face and not said upper face, and opposite longitudinally-extending openwork side edges;

said plurality of hollow recesses being separated and defined by a plurality of upstanding openwork walls extending from said upper face to said lower face and made of said randomly convoluted filaments, said upstanding openwork walls being arranged as a latticework structure such that said plurality of hollow recesses is arranged in a grid pattern defined by said latticework structure of said upstanding openwork walls and such that said upstanding openwork walls extend diagonally across said mat relative to said side edges and a longitudinal axis of said mat;

the randomly convoluted polymeric filaments forming said openwork upper face of said mat having been subject to a flattening process while the filaments were capable of deformation and before the filaments had hardened so that the filaments extending along said openwork upper face provide a flat surface and said randomly convoluted polymeric filaments being self-bonded and fused together and the openwork upper face of said mat having a higher density of filaments than a remainder of said mat extending below said openwork upper face; and said mat providing ventilation passages for air therethrough from said slot to and through said side edges and providing no unobstructed passageways from said side edges to said slot thereby preventing undesired entry of blowing rain or snow.

14. An assembly according to claim 13, wherein said mat consists of melt-spun thermoplastic polymeric filaments extruded in overlapping, irregularly-looped patterns with said polymeric filaments being self-bonded and fused at random points of intersection without bonding agents or inserts.

15. An assembly according to claim 14, wherein said side edges of said mat are formed by looped uncut sections of said filaments.

16. An assembly according to claim 14, wherein said side edges of said mat are formed essentially by severed ends of said filaments.

17. An assembly according to claim 13, wherein each of said plurality of hollow recesses has an openwork base made of convoluted polymeric filaments, and wherein said polymeric filaments of said bases form parts of said openwork upper face.

18. An assembly according to claim 17, wherein said upstanding openwork walls of said latticework structure extend across said mat from one of said side edges to the other at a 45° angle to said side edges and a longitudinal axis of said mat.

19. An assembly according to claim 18, wherein said mat includes a central longitudinally-extending hinge portion and opposite laterally-extending flap portions extending from opposite sides of said hinge portion, wherein said hinge portion is flexible and permits said mat to conform to an inverted-V shape of said underlying roof ridge, and wherein said grid pattern of recesses and said latticework structure of upstanding openwork walls continue uninterrupted throughout said flap portions and across said hinge portion, and wherein said hinge portion has a lower density of randomly convoluted polymeric filaments so as to provide the hinge portion with greater flexibility.

20. An assembly according to claim 19, wherein a density of convoluted polymeric filaments within said hinge portion is less than a density of convoluted polymeric filaments in said opposite laterally-extending flap portions.

21. A roof ridge vent, comprising:

an elongate openwork mat made of randomly convoluted polymeric filaments, said mat having a first face, an opposite second face, opposite longitudinally-extending side edges, and a plurality of hollow recesses extending into said mat and opening into said second face and not said first face;

said plurality of hollow recesses being separated by a plurality of upstanding walls made of said randomly convoluted polymeric filaments and arranged to form a latticework structure extending along a length of said openwork mat, said recesses being arranged in a grid pattern defined by said latticework structure, and said upstanding openwork walls extending diagonally across said mat relative to said side edges and a longitudinal axis of said mat;

the randomly convoluted polymeric filaments forming said first face of said mat having been subject to a flattening process while the filaments were capable of deformation and before the filaments had hardened so that the filaments extending along said first face provide a flat surface and extend within a common plane, said randomly convoluted polymeric filaments being self-bonded and fused together, and the first face of said mat having a higher density of filaments than a remainder of said mat such that the first face is of sufficient density to catch heads of fasteners and to prevent heads of said fasteners from passing through the mat;

said openwork mat providing ventilation passages therethrough and through said side edges, and said latticework structure of upstanding walls preventing unobstructed passage of blowing rain or snow into said side edges and laterally through said openwork mat;

wherein said mat includes a central longitudinally-extending hinge portion and opposite laterally-extending flap portions extending from opposite sides of said hinge portion, wherein said hinge portion is flexible and permits said mat to conform to an inverted-V shape of said underlying roof ridge, and wherein said grid pattern of recesses and said latticework structure of upstanding openwork walls continue uninterrupted throughout said flap portions and across said hinge portion.

* * * * *